US007763295B2

(12) United States Patent
Mayr et al.

(10) Patent No.: US 7,763,295 B2
(45) Date of Patent: Jul. 27, 2010

(54) BREWING BAG AND USE THEREOF

(75) Inventors: Peter Mayr, Trippstadt (DE); Peter Muller, St. Leon-Rot (DE); Hans Henkes, Worms (DE); Norbert Goffing, Neunkirchen (DE)

(73) Assignee: Carl Freudenberg KG, Weinheim (DE)

( * ) Notice: Subject to any disclaimer, the term of this patent is extended or adjusted under 35 U.S.C. 154(b) by 319 days.

(21) Appl. No.: 11/897,855

(22) Filed: Aug. 31, 2007

(65) Prior Publication Data

US 2008/0081090 A1 Apr. 3, 2008

(30) Foreign Application Priority Data

Sep. 4, 2006 (DE) ..... 10 2006 041 772

(51) Int. Cl.
*B65B 29/02* (2006.01)

(52) U.S. Cl. ..... 426/77

(58) Field of Classification Search ..... 206/5; 426/77, 78; 442/327, 341, 361
See application file for complete search history.

(56) References Cited

U.S. PATENT DOCUMENTS

| | | | | |
|---|---|---|---|---|
| 2,414,833 | A | 1/1947 | F.H. Osborne | |
| 6,458,726 | B1 * | 10/2002 | Harrington et al. | 442/364 |
| 2005/0136155 | A1 * | 6/2005 | Jordan et al. | 426/77 |
| 2008/0166454 | A1 * | 7/2008 | Mayr et al. | 426/84 |

FOREIGN PATENT DOCUMENTS

| | | | |
|---|---|---|---|
| AT | 14764 | B | 8/1985 |
| DE | 21 47 322 | C2 | 3/1972 |
| DE | 103 43 032 | A1 | 9/2003 |
| EP | 0059 608 | A1 | 9/1982 |
| EP | 08 22 284 | B1 | 5/1997 |
| EP | 15 53 224 | A1 | 7/2005 |
| GB | 111189 | | 11/1917 |
| GB | 1294064 | | 10/1972 |
| JP | 2004-2 11 251 | A | 7/2004 |
| JP | 2004-2 42 944 | A | 9/2004 |
| JP | 2004-3 38 750 | A | 12/2004 |
| WO | WO 02/480443 | A1 | 6/2002 |
| WO | WO 04/0 72 371 | A1 | 8/2004 |

* cited by examiner

*Primary Examiner*—Arti Singh-Pandey
(74) *Attorney, Agent, or Firm*—Pearl Cohen Zedek Latzer, LLP

(57) ABSTRACT

An infusion bag made of a nonwoven textile fabric is described, which includes fibers and/or filaments made of at least one filter material, the textile fabric having a hot-sealable surface which is formed by hot-sealable fibers and/or filaments made of at least one hot-sealable material. It is provided according to the present invention that the fibers and/or filaments made of the filter material and the fibers and/or filaments made of the hot-sealable material are present in the textile fabric in the form of a mixture, the proportion of the fibers and/or filaments made of the hot-sealable material increasing over the cross section toward the hot-sealable surface of the textile fiber as a gradient. The infusion bag according to the present invention is characterized by excellent filtering properties, high visual transparency, and an excellent pop-up function and is manufacturable simply and economically as a single-layer product. It is particularly well-suited for use as a tea bag or a coffee pod.

17 Claims, 1 Drawing Sheet

BREWING BAG AND USE THEREOF

The present invention relates to an infusion bag made of a nonwoven textile fabric, which includes fibers and/or filaments made of at least one filter material, the textile fabric having a hot-sealable surface which is formed by hot-sealable fibers and/or filaments made of at least one hot-sealable material. The present invention furthermore relates to uses of an infusion bag according to the present invention.

BACKGROUND

JP 2004338750 A and JP 2004242944 A describe infusion bags which are made of spunbonded nonwoven made of core/sheath fibers having a high-melting core component and a low-melting sheath component. The high-melting core component is made of a polyester, in particular polyethylene terephthalate; the low-melting sheath component is made of polypropylene or polyethylene. The low-melting sheath component is responsible for the hot sealability of the material.

Infusion bags of the above-mentioned type, which are made of dual-layer textile fabric, are currently being offered on the market. One layer is responsible for the filtering properties such as particle retaining capability, water permeability, and permeability for the extracted active substances, as well as for the mechanical strength. The second layer is used for the hot sealability of the textile fabric and is made of fibers of thermoplastic polymers, in particular of polyethylene and polypropylene.

The disadvantage of the known infusion bags is their higher manufacturing complexity, higher manufacturing costs due to the spinning and applying of the second layer, the low transparency due to the dual-layer structure, the lower melting points of the fabrics in the second layer, in particular of polyethylene and polypropylene, which may result in conglutination at the cut edges during the manufacture of the base material.

SUMMARY OF THE INVENTION

In accordance with an embodiment of the present invention, an infusion bag made of a nonwoven textile fabric, which includes fibers and/or filaments made of at least one filter material, the textile fabric having a hot-sealable surface which is formed by hot-sealable fibers and/or filaments made of at least one hot-sealable material, wherein the fibers and/or filaments made of the filter material and the fibers and/or filaments made of the hot-sealable material are present in the textile fabric in the form of a mixture, the proportion of the fibers and/or filaments made of the hot-sealable material increasing over the cross section toward the hot-sealable surface of the textile fiber as a gradient.

BRIEF DESCRIPTION OF DRAWINGS

The present invention is described in greater detail on the basis of the drawings, in which.

DETAILED DESCRIPTION OF THE INVENTION

Figure 1:
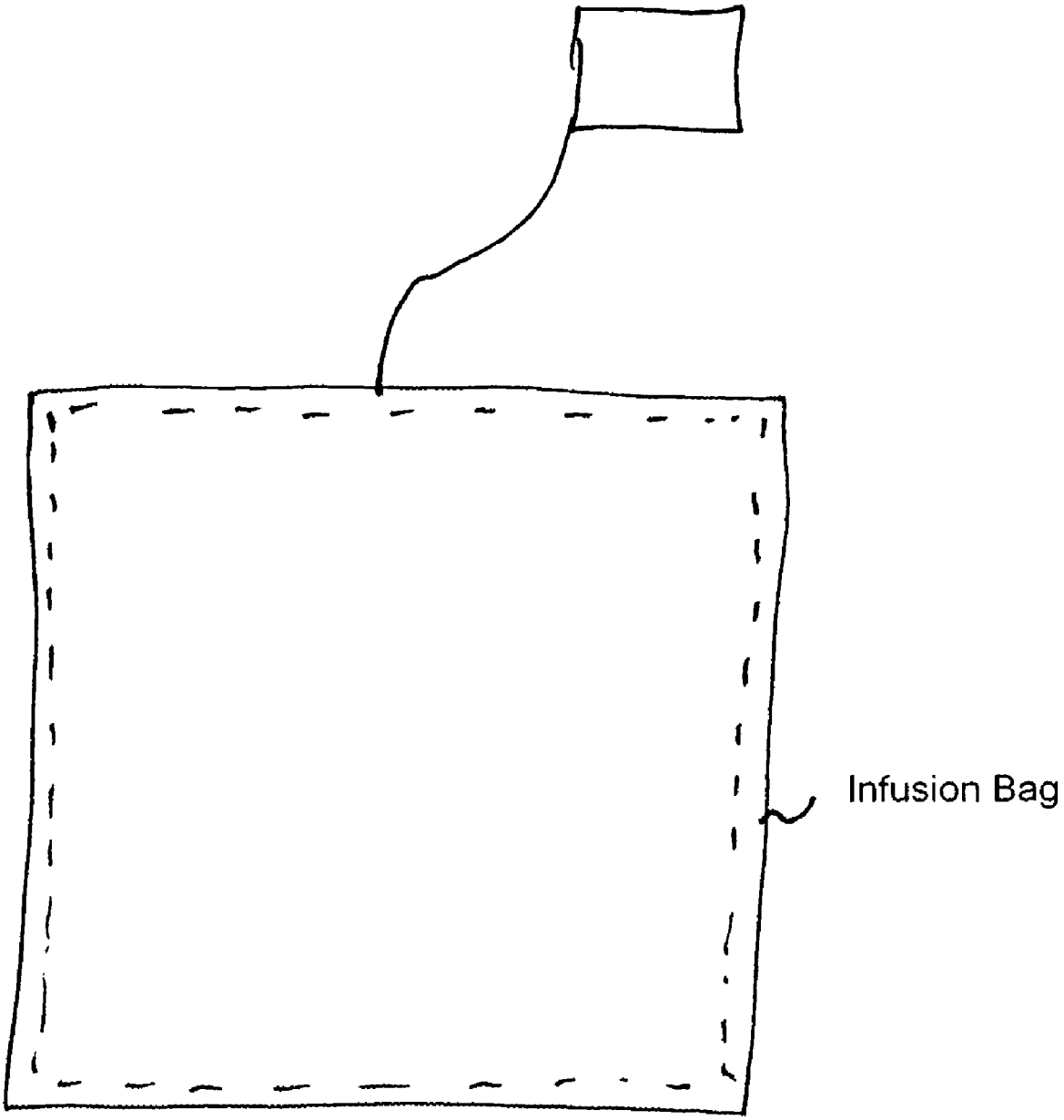
FIG. 1 shows an infusion bag.

The object of the present invention is to refine an infusion bag of the above-mentioned type in such a way that it has excellent filtering properties, is manufacturable in a simple and cost-effective manner, and, additionally, is appealing both visually and with regard to its use.

This object is achieved by an infusion bag having all the features of claim 1. The subclaims describe advantageous embodiments of the present invention. Claims 15 through 17 describe preferred applications.

According to the present invention, for an infusion bag made of a nonwoven textile fabric, which includes fibers and/or filaments made of at least one filter material, the textile fabric having a hot-sealable surface which is formed by hot-sealable fibers and/or filaments made of at least one hot-sealable material, it is provided that the fibers and/or filaments of the filter material and the fibers and/or filaments of the hot-sealable material in the textile fabric are present in the form of a mixture, the proportion of fibers and/or filaments made of the hot-sealable material increasing over the cross section toward the hot-sealable surface of the textile fabric as a gradient.

It has been surprisingly found that the gradient structure makes it possible to dispense with a multilayer structure of the textile fabric in which each layer is assigned a specific function such as filtering action, hot sealability, etc., and instead to combine all these functions in a single nonwoven layer. The infusion bag according to the present invention is thus manufacturable in a simple and cost-effective manner. The hot-sealable fibers and/or filaments present in a high proportion on one surface of the textile fabric are entirely sufficient for producing a reliable weld of the material, for example, when manufacturing the bag. On the other hand, the fibers and/or filaments made of the filter material which are present in a high proportion in particular on the surface opposite the sealing surface ensure the uniformity, density, and strength of the material required for a good filtering action. Furthermore, higher transparency of the uniform fabric is achieved due to the single-layer structure in which preferably only raw materials of the same type are used (e.g., PET and CoPET).

According to the present invention, the proportion of the hot-sealable components is to increase toward the sealing surface of the textile fabric as a gradient. This means that the changes in concentration over the layer thickness occur in such a way that a phase boundary is not recognizable in any cross-section surface parallel to the surface of the textile fabric. The change in concentration occurs continuously over the layer thickness. The concentration of the hot-sealable component changes linearly in use of the infusion bag, i.e., it increases from a minimum concentration value ($\geqq 0\%$) to a maximum concentration ($\leqq 100\%$). Any other change in concentration besides a linear change is possible over the distribution and the ratio of the two components in the shaping spinning tool.

Surface of the textile fabric is understood in the context of the present invention as the surface of the textile fabric which is adjacent to a pick-up band when the fibers and/or filaments are deposited on this pick-up band or the surface of the textile fabric opposite to this surface.

The materials for the fibers and/or filaments made of a hot-sealable material preferably include any thermoplastic polymers which are sufficiently temperature- and medium-resistant for use as an infusion bag.

In a preferred specific embodiment of the present invention, the fibers and/or filaments of a hot-sealable material include bicomponent fibers and/or filaments having a high-melting and a low-melting component. Particularly preferably core/sheath fibers and/or filaments are used, the high-melting component forming the core and the low-melting component forming the sheath as essentially known. The present invention, however, is by no means restricted to core/sheath fibers and/or filaments. In principle, any other bicomponent fiber types such as side-by-side fibers are also suitable.

According to a preferred specific embodiment of the present invention, bicomponent fibers and/or filaments made of copolyethylene terephthalate/polyethylene terephthalate (CoPET/PET) or also polybutylene terephthalate/polyethylene terephthalate (PBT/PET) may also be used. The melting points of CoPET and PET are approximately 180° C. to 225° C.; those of PET are 235° C. to 265° C. These fibers thus have the required temperature and media resistance. Furthermore, the difference in melting points between the core and sheath components is sufficiently great to ensure weldability of the fiber material without impairing the core component. The material is welded to form infusion bags in the known manner by applying thermal energy or using ultrasonic welding.

Bicomponent fibers or filaments made of CoPET/PET are essentially known. They are normally used as binding fibers/filaments for a variety of applications. They are characterized not only by extraordinary temperature stability, but also by very high rigidity. It has been found that this high rigidity of the material results in a substantially improved visual appearance of an infusion bag manufactured thereof. An infusion bag according to the present invention is characterized by an excellent pop-up function. This means that the infusion bag is dimensionally stable and even in the event of mechanical deformation, for example, during packaging, it assumes its original shape upon being removed from the package. Due to these fibers and/or filaments being mixed in as a gradient, the textile fabric still remains sufficiently flexible overall so it may be easily further processed.

Furthermore, bicomponent fibers and/or filaments of PET/polyethylene and/or PET/polypropylene may also be additionally used. When using these materials, attention must be paid so no excessive heat is generated when cutting the nonwovens which would result in smudging of the lower-melting polymers at the cut edges.

Regarding a suitable filter material there is also only the limitation that it must be sufficiently temperature and media resistant. Fibers and/or filaments made of PET are preferably used as the filter material, in particular in combination with bicomponent fibers made of CoPET/PET as the hot-sealable material because both components are similar in their chemical composition, bond well to each other, and provide good dimensional stability due to their rigidity. The infusion bag according to the present invention is, however, not limited to this raw material combination. Basically other spinnable raw materials having sufficiently high temperature and media resistance may be used. The difference in the melting points of filtering and hot-sealable materials must be sufficiently great to ensure the bonding function. In the case of food applications, also only raw materials complying with the legal requirements for foodstuff may be used.

The infusion bag according to the present invention is by no means limited to the use of only one filtering material or only one hot-sealable material. Fiber and filament mixtures may also be used.

The infusion bag according to the present invention is preferably manufactured of a spunbonded nonwoven in which the risk of individual fibers coming loose, as is the case, for example, when using staple fibers, is low.

The mass per unit area of the nonwoven used for the infusion bag according to the present invention is preferably between 14 g/m$^2$ and 40 g/m$^2$, in particular between 14 g/m$^2$ and 18 g/m$^2$ for tea bag applications. At lower mass per unit area, the nonwoven layer is excessively non-uniform; at higher mass per unit area, the transparency of the material is impaired.

The thickness of the nonwoven material used is preferably between 0.05 mm and 0.3 mm, in particular between 0.05 mm and 0.11 mm for tea bag applications. At an excessively small thickness, the rigidity of the material is substantially reduced. The visual appearance of an infusion bag made of this material is impaired. In contrast, at high thicknesses the processability of the material deteriorates.

The fiber and/or filament thickness of a nonwoven material used for an infusion bag according to the present invention is preferably between 1.4 dtex and 2 dtex. At excessively low filament and/or fiber thicknesses, the material is so dense that the liquid exchange or substance exchange is impaired. Excessively high fiber thicknesses may also result in losses of the active substance contained.

The penetration rate should preferably be less than 3 percent. Penetration rate of the nonwoven is understood as the passage or loss of certain tea particle or grain fractions through the nonwoven structure. A low penetration rate means that the tea particles/components are largely retained in the infusion bag.

The per-hole throughput is preferably between 0.4 g and 0.7 g per hole and minute. This range of per-hole throughputs has been found to be advantageous with respect to the resulting nonwoven properties, penetration rates, economy, and processability.

A possible method for manufacturing nonwovens having concentration gradients, in particular of nonwovens made of monocomponent and bicomponent filaments in which the relative proportion of the monocomponent and bicomponent filaments varies as a gradient over the nonwoven cross section is [described], for example, in EP 0 822 284 B1. Such a method may also be used for manufacturing an infusion bag according to the present invention.

An infusion bag according to the present invention is characterized by high strength and media resistance. At the same time, it has a high penetrability for the liquids used for brewing and for the active substances extracted during brewing, while undesirable fine and ultrafine particles are reliably retained in the bag. When using smooth calander rollers in manufacturing the nonwoven, the material is highly transparent and therefore highly suitable in particular for applications in which the visual impression is also important in addition to the good infusion properties, for example, for tea bag applications.

An infusion bag according to the present invention is therefore preferably used as a tea bag. As mentioned previously, the nonwoven material used for this application is to be advantageously smooth-calandered as an alternative to dot-engraving to ensure the highest possibly transparency. The excellent visual impression is further enhanced when using CoPET/PET fibers and/or filaments due to the high pop-up capability of the bag.

Another preferred application of the nonwoven according to the present invention is the use as a coffee pod. For this application, end users usually prefer a less transparent material, which is easily implemented, for example, by the use of engraving rollers when calandering the nonwoven.

The infusion bag according to the present invention may also be used in general as a container for active substances in both hot and cold applications. Thus, for example, the use for hot drinks or refreshments is conceivable. Its use for soups, for example, is also conceivable. In the case of medicinal baths, for example, chamomile baths, infusion bags according to the present invention may also be used. The infusion bag according to the present invention is, however, by no means limited to the above-described applications.

The invention claimed is:

1. An infusion bag made of a nonwoven textile fabric, which includes fibers and/or filaments made of at least one filter material, the textile fabric having a hot-sealable surface which is formed by hot-sealable fibers and/or filaments made of at least one hot-sealable material, comprising fibers and/or filaments made of the filter material and fibers and/or filaments made of the hot-sealable material, present in the textile fabric in the form of a mixture, the proportion of the fibers and/or filaments made of the hot-sealable material increasing over the cross section toward the hot-sealable surface of the textile fibers and/or filaments as a gradient.

2. The infusion bag as recited in claim 1, wherein the fibers and/or filaments made of the hot-sealable material include bicomponent fibers and/or filaments.

3. The infusion bag as recited in claim 2, wherein the bicomponent fibers and/or filaments include core/sheath fibers and/or filaments having a high-melting core component and a low-melting sheath component.

4. The infusion bag as recited in claim 2 wherein the bicomponent fibers and/or filaments include CoPET/PET fibers and/or filaments.

5. The infusion bag as recited in claim 1, wherein the fibers and/or filaments made of filtering material include polyethylenephthalate fibers and/or filaments.

6. The infusion bag as recited in claim 1, wherein the mass per unit area of the textile fabric is 14 $g/m^2$ to 40 $g/m^2$.

7. The infusion bag as recited in claim 1, wherein the thickness of the textile fabric is 0.05 mm to 0.3 mm.

8. The infusion bag as recited in claim 1, wherein the fiber/filament thickness of the bicomponent fibers and/or filaments is 1.4 dtex to 2.0 dtex.

9. The infusion bag as recited in claim 1, wherein the fiber/filament thickness of the filter fibers and/or filaments is 1.4 dtex to 2.0 dtex.

10. The infusion bag as recited in claim 1, wherein the penetration rate is <3%.

11. The infusion bag as recited in claim 1, wherein the per-hole throughput is 0.4 to 0.7 g/hole-min.

12. The infusion bag as recited in claim 1, wherein the nonwoven is smooth calandered.

13. The infusion bag as recited in claim 1, wherein the nonwoven is calandered using an engraving roller.

14. A method of using the infusion bag as recited in claim 1 comprising:

providing tea leaves within the infusion bag.

15. A method of using the infusion bag as recited in claim 1 comprising:

providing coffee within the infusion bag.

16. A method of using the infusion bag as recited in claim 1 comprising:

providing soups of medicinal baths within the infusion bag.

17. The infusion bag as recited in claim 1, wherein the nonwoven is a spunbonded nonwoven.

* * * * *